US008376348B2

(12) United States Patent
Keller

(10) Patent No.: US 8,376,348 B2
(45) Date of Patent: Feb. 19, 2013

(54) DEVICE AND METHOD FOR THE TRANSFER OF FLEXIBLE, ELONGATE OBJECTS

(75) Inventor: Alex Keller, Rapperswil (CH)

(73) Assignee: Ferag AG, Hinwil (CH)

( * ) Notice: Subject to any disclaimer, the term of this patent is extended or adjusted under 35 U.S.C. 154(b) by 171 days.

(21) Appl. No.: 12/652,481

(22) Filed: Jan. 5, 2010

(65) Prior Publication Data

US 2010/0171261 A1 Jul. 8, 2010

(30) Foreign Application Priority Data

Jan. 8, 2009 (CH) ..... 0019/09

(51) Int. Cl.
*B65H 5/22* (2006.01)

(52) U.S. Cl. ..... 271/3.18; 271/277; 271/204; 271/206; 271/268; 271/69

(58) Field of Classification Search ..... 271/69, 271/3.18, 204, 206, 268, 277
See application file for complete search history.

(56) References Cited

U.S. PATENT DOCUMENTS 4,201,286 A * 5/1980 Meier ..... 198/461.3
6,672,447 B2 1/2004 Muller
6,814,352 B2 * 11/2004 Ramseier ..... 271/69
6,851,544 B2 * 2/2005 Noll, Jr. ..... 198/470.1
6,976,674 B2 12/2005 Honegger
7,591,466 B2 9/2009 Kyburz
2010/0200368 A1 * 8/2010 Keller ..... 198/470.1
2011/0284342 A1 * 11/2011 Berni ..... 198/470.1

FOREIGN PATENT DOCUMENTS

EP 1281650 A1 2/2003
EP 1321410 A1 6/2003
EP 1834911 A1 9/2007

* cited by examiner

*Primary Examiner* — Michael McCullough
*Assistant Examiner* — Howard Sanders
(74) *Attorney, Agent, or Firm* — Rankin, Hill & Clark LLP

(57) ABSTRACT

A device and method for transferring flexible flat objects, in particular printed products, between two conveyors. The device includes a first gripper conveyor with first grippers moved along a first gripper conveyor path for hanging transport of the objects in a conveyor direction by gripping a first object edge, a second gripper conveyor with second grippers moved along a second gripper conveyor path, for receiving the objects by gripping a second object edge which lies opposite the first object edge, and at least one actuation device for opening and closing the first and second grippers such that, in a transfer region, the objects may be transferred from the first grippers to the second grippers. The distances of the first and the second grippers are different to one another in front of the transfer region, wherein the distances of the first grippers are smaller than that of the second grippers.

15 Claims, 2 Drawing Sheets

T
S1
40
U1'
1
b1
d1'
S3
G
50
F
14
13
10
b1
19
ℓ1
E
18
20
U2
12
S2
3
2
22
d1
4
33
32
34
30
24
23

S1
T
40
S3
10
E
12
20
U2
S2
2
22
3'
2'
2'
4'

DEVICE AND METHOD FOR THE TRANSFER OF FLEXIBLE, ELONGATE OBJECTS

BACKGROUND OF THE INVENTION

1. Field of the Invention

The invention lies in the field of conveyor technology and relates to a device and to a method for the transfer of flexible, flat objects, in particular printed products, between two conveyors.

2. Description of Related Art

In conveyor technology and in particular in the field of printing technology, it is often necessary to transfer objects from grippers of a first gripper conveyor into grippers of a second gripper conveyor. Printed products coming from a printing machine are held and conveyed by a gripper.

Various ways as to how such a transfer between two gripper conveyors may occur is sketched in EP-B 1321410. EP-A 1834911 describes a further transfer device, with which individual objects are transferred from first grippers to second grippers. The second grippers are arranged in each case below the first grippers. The first grippers are opened in a transfer region, so that the objects, on account of gravity, slide into the co-moved open second grippers, which are thereupon closed.

Often, the mutual distance of the grippers between the first and the second gripper conveyor is different, and as a rule the distance of the first grippers is smaller than the distance of the second grippers. In the state of the art, the speeds of the two gripper conveyors are therefore selected adapted to one another such that the first and the second grippers are synchronised in the transfer region and execute no movements relative to one another seen in the conveyor direction, in order not to upset the transfer process by way of displacement in the conveyor direction.

On separating out objects transferred in pairs, but also with the transfer of individual objects from a first gripper to a second one, special demands are made to the extent that the object edge which is not gripped is reliably positioned such that it is led as precisely as possible into the open gripper jaw of the second gripper. This, above all, is important with flexible products such as e.g. printed products, since on conveying, they are only held at one product edge and may change their position or deform on account of external influences such as e.g. drafts.

With EP-A 1834911, the distance of the first to the second gripper conveyor path is constant in the transfer region. The objects which are released by the first gripper are led into the second gripper supported by gravity by way of a support device in the form of two laterally engaging spirals which define a support surface co-moved with the second gripper taking over. They are temporarily not held during the transfer. Also with EP-B 1321410, the first gripper is opened before the synchronously co-moved second gripper is closed.

It is the object of the invention to further improve known devices and methods for the transfer of flexible, flat objects from a first gripper conveyor to a second gripper conveyor, in particular in order to be able to transfer and/or collate the objects in a reliable and easily controllable manner.

BRIEF SUMMARY OF THE INVENTION

The device according to the invention comprises a first gripper conveyor with first grippers moved along a first gripper conveyor path, for the essentially hanging transport of the objects in a conveyor direction. Hereby, first object edges are gripped by the first grippers. The first grippers are attached on a continuously driven, first drive member and in the case of operation are moved at an essentially constant speed. The objects are conveyed individually or in groups, and with a grouped conveying, the first object edges may lie on one another or be offset from one another within the gripper. Moreover, a second gripper conveyor with second grippers moved along a second gripper conveyor path is present. These grippers receive the objects by way of then gripping a second object edge, which lies opposite the first object edge. They may already contain objects, wherein the objects released by the first grippers may be added to these. The first and the second grippers in each case are attached on a continuously driven first and second drive member respectively, e.g. a chain, wherein the respective conveyor path is fixed by way of suitable guides. Moreover, at least one actuation device is present for opening and closing the grippers, e.g. in the form of control cams or other elements which initiate the opening or closure procedure. Preferably, each conveyor has its own actuation device. The conveyor paths and the actuation device are designed and set up such that a transfer of the objects from the first grippers to the second grippers may take place in a transfer region. The distances of the first grippers amongst one another in front of the transfer region are smaller than the distances of the second grippers there. According to the invention, the distances of the first and/or second grippers are variable along their conveyor path. The distances of the first grippers in the transfer region are reduced compared to their distances in front of the transfer region. Alternatively or additionally, the distances of the second grippers in the transfer region are increased with respect to their distances in front of the transfer region. A difference in the distances of the first and second grippers in front of the transfer region is therefore increased even more. In other words, the path speeds of the first or second grippers, proceeding from the respective constant base drive speeds (e.g. the speed of the drive member) is changed in the transfer region such that the second grippers may catch up with respect to the first grippers. The first grippers are, thus, delayed briefly and/or the second grippers are accelerated.

With regard to the method, the following steps are present: conveying the objects with the first gripper conveyor in an essentially hanging manner in the conveyor direction, wherein the first grippers hold the objects on a first object edge; further conveying of the objects by the second gripper conveyor, wherein the second grippers hold a second object edge which lies opposite the first object edge; transfer of the objects from the first grippers to the second grippers in the transfer region by way of opening the first grippers and closing the second grippers; moving the first and the second grippers in a manner such that the distances of consecutive first grippers in front of the transfer region are smaller than the distances of consecutive second grippers in front of the transfer region. According to the invention, the distances along the respective gripper conveyor path of consecutive first and/or second grippers is changed in a manner such that the distances of the first grippers in the transfer region are reduced with respect to their distances in front of the transfer region and/or that the distances of the second grippers in the transfer region are increased with respect to their distances in front of the transfer region.

The conveyor speeds of the first and second grippers are selected such that a second gripper is assigned to each first gripper and in the transfer region is moved largely, but not exactly, synchronously with the first gripper. A relative movement of the first and second grippers assigned to one another with a speed component in the conveyor direction is achieved by way of the distance change and the otherwise constant drive speed. The second gripper, thus, catches up with respect to the first gripper, so that the distance of the first and second gripper relative to one another reduces, in particular seen along the main surface of the object. By way of this, the object at both edges is enclosed by grippers and the second object edge is positioned gently in the gripper jaw of the second gripper. Before the second gripper is closed, the object is supported preferably on the trailing gripper limb of a leading second gripper and slides along its outer surface into the open gripper jaw. The trailing gripper jaw for this is elongated in particular with respect to the leading gripper jaw, and forms a surfaced support. One may thus make do without additional support means engaging from the outside. Moreover, one succeeds in realising the transfer region in a space-saving manner, in particular if the objects on transfer are already arranged in an imbricate manner, i.e. with a certain oblique position with respect to the vertical, and the first gripper leads the assigned second gripper in the conveyor direction, with a gripper jaw orientated opposite to the conveyor direction.

The distance change is preferably realised by way of the first and/or second gripper being arranged on the first and second drive member respectively, in a projecting manner such that the distance of consecutive grippers may be changed by way of the curvature of the gripper conveyor path. The distances are locally reduced by way of a concave path curvature and are increased by way of the convex path curvature. The grippers may, for example, be connected to the drive member via a lever, wherein the distances of the articulation points of the levers on the drive member are constant. The distance of the grippers is, for example, the distance between a defined location on the gripper and the same location on an adjacent gripper. These reference points may e.g. be the clamping region, the axis of the joint or the base of the gripper. The distance change in another variant may also be achieved by way of pivoting the gripper relative to its drive member.

The first and the second drive member is, for example, a chain led in a channel. The articulation points, on which the grippers are fastened on the drive member, preferably have a constant distance to one another. The grippers are e.g. arranged via a lever or other spacer, at a distance to the articulation points, so that the reference points on the gripper itself have a defined distance to the mentioned deflection points. The path of the drive member, which is fixed by the guide elements, is hereinafter called the gripper conveyor path. It may differ from the path of the reference points on the gripper. The latter is determined by the shape of the gripper conveyor path and/or by a pivotability of the levers or spacers relative to drive member, which may likewise be present as the case may be.

"Projecting", for example, means that the reference points, e.g. the joint axis lies at a distance to the articulation point, which is larger than the distance of two adjacent articulation points or which lies within a similar magnitude to this distance. In the latter case, the distance of the joint axis to the articulation point is preferably 0.1 times, particularly preferably at least 0.2 times and further preferably at least 0.5 times the distance of the articulation points of adjacent grippers.

Transfer region is to be understood as that region, in which the transfer process of the objects from the first grippers to the second grippers may take place, in particular since the grippers have approached one another to such an extent, that a controlled transfer is possible. The object in the transfer region may be influenced by the first grippers as well as by the second grippers, for example the object already touches a second gripper whilst it is still held by the first gripper. A controlled transfer, with which the objects are gripped at each point in time, takes place, for example, by way of the first grippers only being opened after the second grippers have been closed.

The conveyor paths of the first and second grippers are roughly parallel to one another in the transfer region with the exception of the concave/convex dents for the distance change. The distance of the conveyor paths to one another is preferably smaller than a product length, so that the products in a view from above are held overlapping one another, but despite this held individually by grippers, conveyed through the transfer region in a relatively compact and thus space-saving formation. The distance of the conveyor paths is preferably variable for adapting to different formats.

In a further operating mode, the second grippers already contain further objects when they enter into the transfer region. Then in the transfer region, they are briefly opened for receiving objects conveyed past by the first grippers. Thereby, the gripper jaws of the second gripper point essentially upwards, so that the objects do not fall out. The transfer device may thus be used for precollection of small groups of objects.

Preferably, a stabilisation device is located in front of the transfer region, which stabilises the free edges of the objects held by the first grippers and releases them at a well defined location at the entry of the transfer region. The stabilisation device in the operating mode "precollection" may advantageously also act on the further objects in the second grippers, and position these such that they enter the transfer region in a defined position. The objects held by the first and second grippers, in the operating mode "precollection" are inserted into one another in a comb-like or zip-like manner.

BRIEF DESCRIPTION OF THE DRAWINGS

Examples of the invention are represented in the drawings and described hereinafter. There are shown in a purely schematic manner.

DETAILED DESCRIPTION OF THE INVENTION

Figure 3:
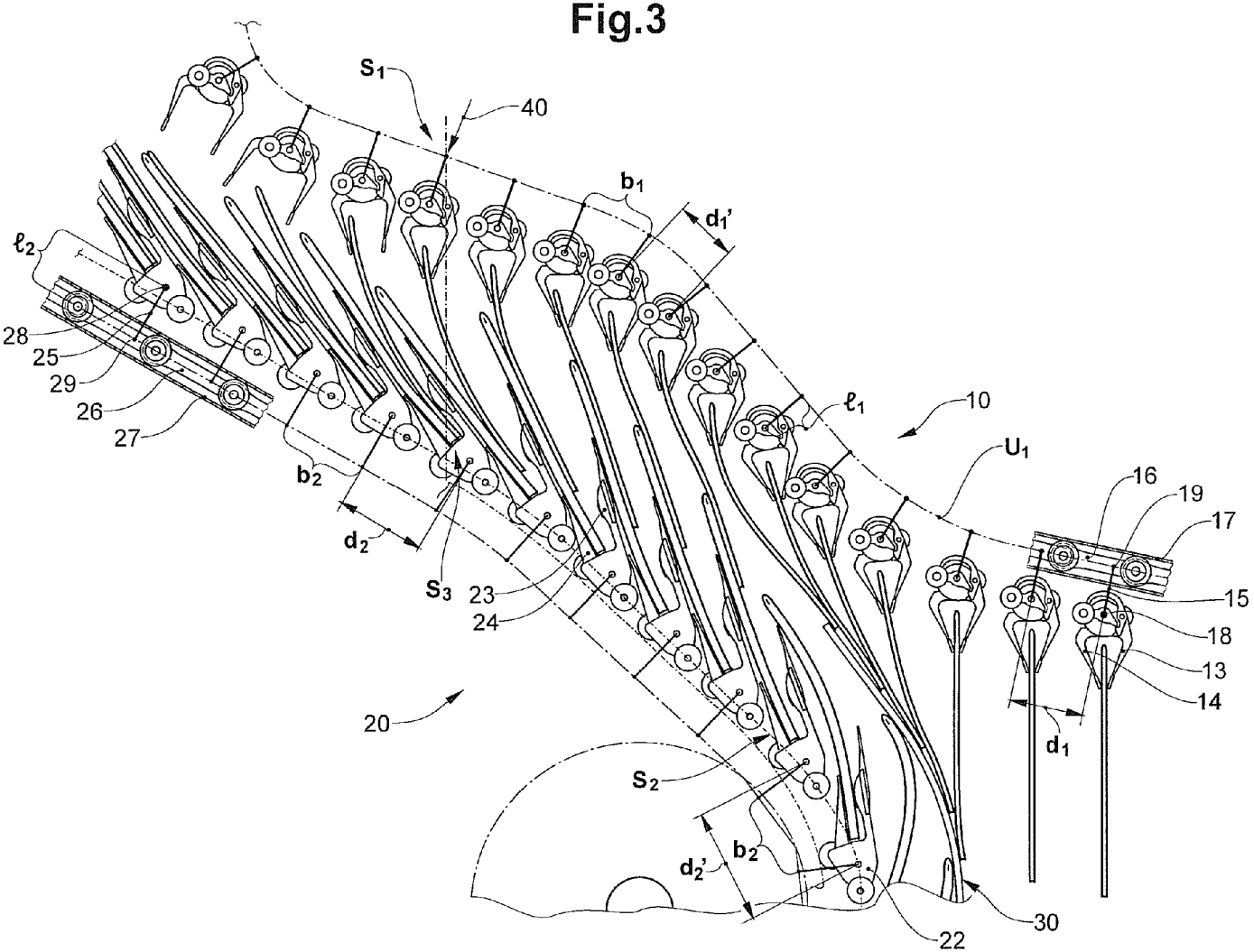

The transfer device 1 comprises a first gripper conveyor 10 with first grippers 12 which are attached on a drive member 16 sketched in FIG. 3, here a chain, and are moved in a conveyor direction F. The spatial position of the drive member 16, and thus the first gripper conveyor path U1 are defined by a guide member 17 (see FIG. 3), here a guide rail or a canal. The first grippers 12 here are conventional grippers with two, in each case roughly equally long gripper jaws 13, 14 which are pivotable about a joint axis 18 and may assume an open position and a clamping position. The first grippers 12 are opened at an opening location S1 by way of a first actuation device 40 which here is indicated only in a schematic manner and may be designed, for example, as a control cam. For cooperation with the actuation device 40, the grippers 12 comprise control elements, e.g. cam rollers, in a manner known per se. The first gripper conveyor path U1 runs obliquely upwards relative to the direction G of gravity. The first grippers 12 convey objects 2 individually or in pairs (not represented) coming from a process situated upstream. Thereby, the objects in each case held at their first edge 3 and the oppositely lying second edges 4, point downwards corresponding to gravity.

The transfer device 1, moreover, comprises a second gripper conveyor 20 with second grippers 22 which are attached on a drive member 26 which is sketched in FIG. 3, here a chain, and are moved in a conveyor direction F. The spatial position of the drive member 26, and thus the second gripper conveyor path U2, is defined by a guide member 27, here a guide rail or a canal. The second grippers 22 likewise have two gripper jaws 23, 24 which are pivotable about a joint axis 28 and whose position relative to one another may be influenced by a second actuation device 50, e.g. a control cam. The actuation device 50 here opens the second grippers at an opening location S2 whose position may be variable and closes these at a closure location S3.

Here, the trailing gripper jaw 23 is extended with respect to the leading gripper jaw 24. It allows the insertion between two objects 2 which are held by the first grippers 12, and the deflection of these into different (adjacent) second grippers 22. Moreover, the extended limb 23 may act as a support surface, along which an object 2 slides into the second gripper 22. With the release of the objects 2 from the first grippers 12, the objects 2 are thus also held in a supported manner by way of the extended limbs 23 or a product already bearing thereon. The second gripper conveyor path U2 here has a deflection of 180° as well as subsequently a section rising upwards with respect to gravity, in which it is located directly below the first gripper conveyor path U1.

The first and second grippers 12, 22 are in each case attached on the drive member 16, 26 in a projecting manner via levers 15, 25 with a length 11 and 12 respectively. The articulation points 19, 29 of the levers 15, 25 on the drive member 16, 26 are located at a constant first or second distance b1, b2 from one another. With this, depending on the curvature of the path U1, U2, a variable distance d1, d1' and d2, d2' of the first and second grippers respectively amongst one another results, measured at the reference points, e.g. here between the joint axes 18, 28 of adjacent grippers. Here, the first conveyor path U1 has a section U1' with a concave curvature. Here therefore, the distances d1' of the first grippers 12 are reduced with respect to the corresponding distances d1 in straight path sections with a constant distance b1.

The length l1 of the lever 15 is preferably of the same magnitude as the distance b1 of the articulation points 19 of the grippers 12 on their drive member, so that the change of the distances d1 of the grippers 12 may be felt. Preferably, $|l1/b1>0.1$, particularly preferably $|l1/b1>0.2$, further preferably $|l1/b1>0.5$. $|l1$ may also be larger than b1 ($|l1/b1>1$).

The levers 15, 25 may also be pivotably arranged on the drive member 16, 26, wherein the pivot position may be controllable by way of additional control elements. A distance change of the grippers 12, 22 may likewise be achieved by way of this.

Figure 2:
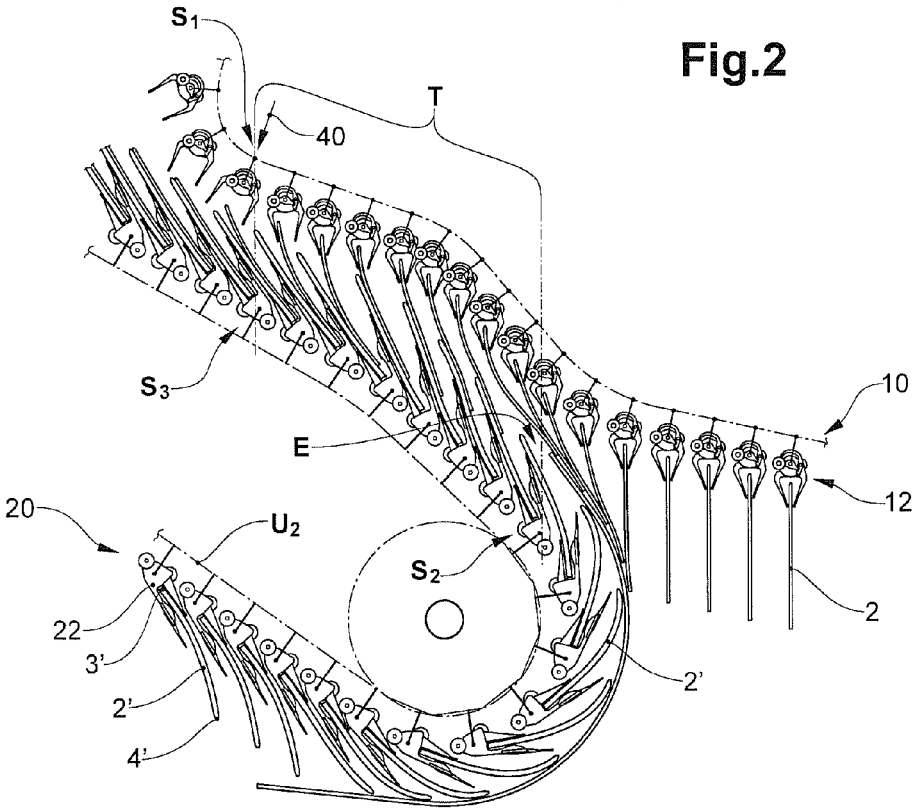
FIGS. 2 and 3 the transfer device of FIG. 1 in the operational mode "precollection".

A stabilisation device 30 is arranged below the first conveyor path U1. This here consists of a stationary guide 32, e.g. of an arched, flat element. It has two surfaces 33, 34, of which one follows the course of the second conveyor path U2 in the region of its deflection, thus describes a 180° circular arc segment in a plan view of the plane of the drawing. Seen from the second conveyor 20, the outer surface 33 of the guide 32, which faces the first gripper conveyor, serves as a support and guide surface for the objects which are held by the first grippers 12, before the transfer. As FIGS. 2 and 3 show, the inner surface 34 facing the second gripper conveyor may serve for supporting and positioning any further products 2', which are already held by the second grippers 22.

The conveyor paths U1, U2 of the two gripper conveyors 10, 20, in a region which is hereinafter so called the transfer region T, approach one another to such an extent that an object 2 which is held by one of the grippers 12, 22 may be influenced by the other gripper, e.g. lies on this. In this manner, a controlled transfer of the objects 2 may take place. The conveyor paths U1, U2 run towards each other at the entry E of the transfer region T with a reduced distance and then preferably run essentially parallel to one another The transfer region T corresponds roughly to the overlap of the rising sections of the first and second conveyor path U1, U2 respectively, up to the closure location S3 of the second grippers 22. The entry E of the transfer region is, for example, that location at which the stabilisation device 30 ends. The gripper conveyors may be part of the superordinate conveyor installation.

The conveyor direction F of both gripper conveyors 10, 20 is directed obliquely upwards in the transfer region T.

Figure 1:
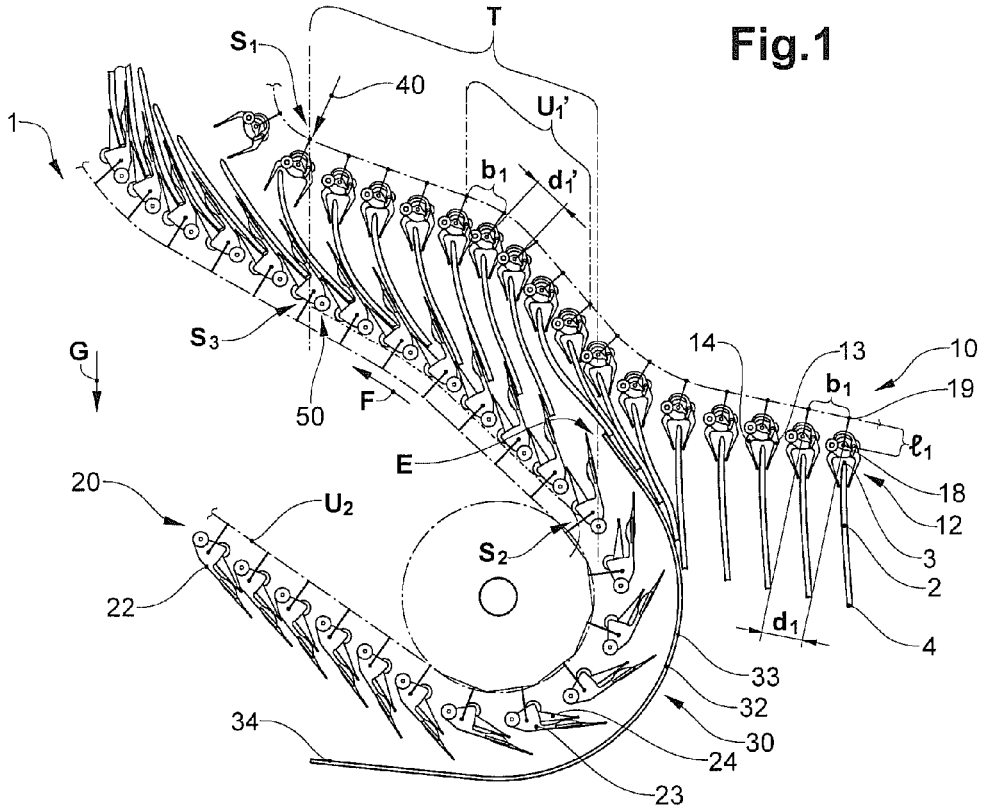
FIG. 1 a transfer region with a first gripper conveyor and with a second gripper conveyor, with the transfer of objects from the first grippers into the second grippers.

The functioning of the transfer device is described hereinafter:

In FIG. 1, the first grippers 12 convey the objects 2 by way of these being held at the first edge 3. The second edge 4, before entry into the transfer region T, is pulled over the outer surface 33 of the guide 32, so that the objects 2 sag opposite to the conveyor direction F. The second edges 4 are abruptly released again at the entry E of the transfer region. The grippers 12, 22 are synchronised such that the second edge 4 on release by the stabilisation device 30, i.e. at its front end, on account of relaxation, springs into the intermediate space between two trailing grippers jaws of adjacent second grippers 22 or into an open second gripper 22. The two edges 4 of the objects 2 are positioned on the long gripper jaws 23 by way of this, and specifically at their outer end. The long gripper jaw 23 of a second gripper 22 in the transfer region is flush with the short gripper jaw 24 of the trailing second gripper 22. It therefore forms a support surface, along which the object may be led into the open gripper jaw of the trailing gripper 22.

This relative movement for introducing the second edges 4 into a respective second gripper 22 is achieved as follows: The first and the second grippers 12, 22 are moved essentially synchronously through the transfer region T at speeds which are adapted to one another. Since the distances b1 of the first grippers (or their articulation points on the drive member) are smaller than the respective distances b2 of the second grippers 22, the second gripper conveyor 20 is driven with a correspondingly greater speed. In the concave region U1' of the first conveyor path U1, the path speed of the first grippers 12 is reduced with respect to the base speed of the drive member 16. The second grippers 22 accordingly catch up with respect to the first grippers 12. The object is led deeper into the jaw mouth of the second gripper 22 by way of this. FIG. 1 shows that the second edge 4 in the course of the transfer region T slides more deeply into the gripper jaw of the second gripper 2, although the distance of the two conveyor paths U1, U2 is even slightly increased in regions on account of the concave curvature.

The conveyor paths U1, U2 are shaped, and the grippers 12, 22, for example, controlled also in their pivot position, such that the gripper jaws of two first and second grippers 12, 22 assigned to one another, point in essentially the same direction but face one another, at least in the first section of the transfer region (roughly up to the end of the concave section U1').

The second gripper 22 may subsequently be closed at the closure location S3 by the actuation device 50. Essentially simultaneously, the first gripper 12 is opened at the opening location S1 by the actuation device 40. A particularly controlled transfer is achieved by way of this. The extended trailing gripper jaws 23 of the second grippers 22, after the transfer, also serve as a support surface for the objects 2, which then are arranged in a leading manner and in a type of imbricate flow.

The operating mode "precollection" is described hereinafter with reference to FIGS. 2 and 3.

With the precollection, the second grippers 22, in each case, already hold one or more objects 2'. These are firstly conveyed forwards in a hanging manner with the free second edge 4' in front. On entry into the deflection, the second edges 4' slide on the inner surface 34 of the guide 32. By way of this, it is ensured that the second edges are always located in front of the held first edges 3' of the same product 2' also in the deflection, where they would sag without auxiliary means on account of the gravity. At the end of the deflection, or at the entry of the transfer region T, the second grippers 22 have changed their orientation in space to such an extent, that the second edges 4' from now on lie on the extended gripper jaws 23 of the leading second gripper 22, by which means the object 2' is supported in a surfaced manner. In the transfer region T, the second grippers may now be opened, and the objects 2 which are held by the first grippers 12, as described above, are introduced into the second grippers 22. The guide 32 thereby serves also for keeping the two product flows separate up to the entry of the transfer region T and there to release the second edges 4 of the objects 2 held by the first grippers 12, in a targeted manner such that they are introduced into the gaps between the further objects 2' in the manner of a zip.

Since the opening of the gripper jaw of the second grippers 22 is orientated obliquely upwards in the transfer region, the already detected objects 2' are not displaced, even with a temporary release of the clamping effect. The second grippers 22 here function as collection compartments. The objects to be taken over are aligned with the already held objects 2' at the base of the gripper 22. After closure of the second grippers 22, the objects 2, 2' are conveyed further in pairs and processed further.

In this operating mode, in a simple and advantageous manner, one already achieves a precollection of objects. The second grippers 22 may subsequently run through yet further correspondingly designed transfer regions.

The invention claimed is:

1. A device for transfer of flexible, flat objects between two conveyors, comprising:

a first gripper conveyor with first grippers that are moved along a first gripper conveyor path and that are fastened on a continuously driven first drive member in a projecting manner, for essentially hanging transport of the objects in a conveyor direction by gripping a first object edge wherein first fastening points, where the grippers are fastened on the drive member, have a constant distance from one another, a second gripper conveyor with second grippers that are moved along a second gripper conveyor path and that are fastened on a continuously driven second drive member in a projecting manner, wherein second fastening points, where the second grippers are fastened on the drive member, have a constant distance from one another, said second grippers receiving the objects by gripping a second object edge that lies opposite the first object edge, at least one actuation device for opening and closing the first and second grippers such that, in a transfer region, a transfer of the objects from the first grippers to the second grippers may take place, wherein the transfer region is the region in which the grippers have approached one another to such an extent that a controlled transfer of the objects from the first grippers to the second grippers is possible, wherein first distances of first consecutive grippers in front of the transfer region are smaller than second distances of second consecutive grippers in front of the transfer region, wherein at least one of the first and second distances are variable, whereby the first distances of consecutive first grippers are locally, in the transfer region, reduced with respect to the first distances in front of the transfer region by way of a concave path curvature, or whereby the second distances of consecutive second grippers are locally, in the transfer region, increased with respect to the second distances in front of the transfer region by way of a convex path curvature.

2. The device according to claim 1, wherein the first gripper conveyor path in the transfer region has a concave section so that the first distance of consecutive first grippers is reduced, and the second gripper conveyor path in the transfer region has a straight or convex section, so that the second distance of consecutive second grippers stays the same or increases.

3. The device according to claim 2, wherein the first and the second grippers are arranged in a projecting manner on their respective drive member via rigid levers, and wherein the levers face one another at least in the transfer region.

4. The device according to claim 2, wherein the actuation device for opening the first grippers acts on the first grippers in or at the end of the concave section.

5. The device according to claim 1, wherein the gripper jaws of the second grippers, trailing in the conveyor direction, are extended with respect to the gripper jaws leading in the conveyor direction, and form a support surface for the objects to be taken over by the subsequent gripper.

6. The device according to claim 1, wherein a stabilization device is provided to stabilize objects held by the first grippers in front of the transfer region.

7. The device according to claim 6, wherein the stabilization device comprises a guide that, in front of the transfer region, forms a support surface running essentially parallel to the second gripper conveyor path.

8. The device according to claim 1, wherein the first and the second gripper conveyor path in the transfer region rise obliquely upwards.

9. The device according to claim 1, wherein the gripper jaw of the second grippers in the transfer region is orientated essentially in the conveyor direction or obliquely upwards.

10. A method for the transfer of flexible flat objects between two conveyors comprising the steps of:

conveying the objects with a first gripper conveyor, comprising first grippers being fastened on a first drive member in a projecting manner, along a first gripper conveyor path, in an essentially hanging manner in a conveyor direction, wherein the fastening points, on which the grippers are fastened on the drive member have a constant distance from one another, and wherein the first grippers hold the objects on a first object edge, further conveying the objects with a second gripper conveyor, comprising second grippers being fastened on a second drive member in a projecting manner, moved along a second gripper conveyor path, wherein the fastening points, on which the grippers are fastened on the drive member, have a constant distance to one another, and wherein the second grippers hold a second object edge which lies opposite the first object edge, transferring the objects from the first grippers to the second grippers in a transfer region by opening the first grippers and closing the second grippers, wherein the transfer region is the region in which the grippers have approached on another to such an extent, that a controlled transfer of the objects from the first grippers to the second grippers is possible, moving the first and second grippers such that first distances of consecutive first grippers in front of the transfer region are smaller than second distances of consecutive second grippers in front of the transfer region;

changing the first distances along the first gripper conveyor path of consecutive first grippers in the transfer region by way of a concave path curvature such that the first distances of the first grippers in the transfer region are reduced with respect to the first distances in front of the transfer region or changing the second distances along the second gripper conveyor path of consecutive second grippers in the transfer region by way of a convex path curvature such that the second distances of the second grippers in the transfer region are increased with respect to the second distances in front of the transfer region.

11. The method according to claim 10, wherein the first gripper in the transfer region is moved relative to an assigned second gripper such that an object held by the first gripper is introduced into an open gripper jaw of the assigned second gripper before the held object is released by the first gripper.

12. The method according to claim 10, wherein the first and second grippers are moved in each case with an essentially constant base speed of the corresponding drive member, wherein a path speed of the first grippers in the transfer region is reduced with respect to the base speed of the corresponding first drive member, and/or a path speed of the second grippers in the transfer region is increased with respect to the base speed of the corresponding second drive member.

13. The method according to claim 10, wherein the objects conveyed by the first grippers are stabilized in front of the transfer region at their hanging-down second edges by dragging the objects over a guide.

14. The method according to claim 10, wherein the second grippers, before entry into the transfer region already convey further objects, and wherein edges which are not held are arranged leading in the conveyor direction, and in the transfer region the second grippers additionally take over the objects conveyed past by the first grippers, so that in each case several objects are conveyed further by the second grippers.

15. The method according to claim 14, wherein the edges of the further objects, said edges which are not being held, are stabilized in front of the transfer region by sliding along a support element.

* * * * *